US009700906B2

(12) United States Patent
Steiger

(10) Patent No.: US 9,700,906 B2
(45) Date of Patent: Jul. 11, 2017

(54) SPRAY COATING DEVICE FOR COATING MATERIAL

(75) Inventor: Ronald Steiger, Roedermark (DE)

(73) Assignee: CARLISLE FLUID TECHNOLOGIES, INC., Charlotte, NC (US)

( * ) Notice: Subject to any disclaimer, the term of this patent is extended or adjusted under 35 U.S.C. 154(b) by 993 days.

(21) Appl. No.: 12/769,849

(22) Filed: Apr. 29, 2010

(65) Prior Publication Data

US 2010/0327088 A1 Dec. 30, 2010

Related U.S. Application Data

(60) Provisional application No. 61/173,726, filed on Apr. 29, 2009.

(51) Int. Cl.

| | |
|---|---|
| ***B05B 7/12*** | (2006.01) |
| ***B05B 7/24*** | (2006.01) |
| ***B05B 5/03*** | (2006.01) |
| ***B05B 7/06*** | (2006.01) |
| ***B05B 7/08*** | (2006.01) |
| *B05B 7/16* | (2006.01) |

(52) U.S. Cl.

CPC ..... *B05B 7/2464* (2013.01); *B05B 5/03* (2013.01); *B05B 7/066* (2013.01); *B05B 7/0815* (2013.01); *B05B 7/16* (2013.01)

(58) Field of Classification Search

CPC .. B05B 5/03; B05B 7/06; B05B 7/066; B05B 7/0807; B05B 7/0815; B05B 7/12; B05B 7/16; B05B 7/2402; B05B 7/2464

USPC ..... 239/423, 424

See application file for complete search history.

(56) References Cited

U.S. PATENT DOCUMENTS

| | | | | |
|---|---|---|---|---|
| 2,714,833 | A * | 8/1955 | Gilbert, Jr. | 431/126 |
| 3,227,377 | A * | 1/1966 | Bartel | 239/124 |
| 4,610,760 | A * | 9/1986 | Kirkpatrick et al. | 159/4.01 |
| 7,575,182 | B2 * | 8/2009 | Rogers, II | 239/424 |
| 2007/0266591 | A1 * | 11/2007 | Rogers | 34/585 |

* cited by examiner

*Primary Examiner* — Christopher Kim

(74) *Attorney, Agent, or Firm* — Hauptman Ham, LLP

(57) ABSTRACT

In a spray coating apparatus having a spray coating gun with a gun body and a coating material tube, a nozzle provided at the front end of the coating material tube, the coating material tube extends from the nozzle at the front end of the coating material tube to a connection piece at the rear end of the coating material tube. A metering system which can be connected to the coating material tube by the connection piece is provided for setting the amount of coating material that is fed to the nozzle per unit of time.

9 Claims, 4 Drawing Sheets

SPRAY COATING DEVICE FOR COATING MATERIAL

The invention relates to a spray coating apparatus for coating material, in particular coating liquid, the spray coating apparatus comprising a spray coating gun with a gun body and a coating material tube, by means of which coating material is fed to a nozzle provided at the front end of the coating material tube.

A spray coating apparatus of this type or spray coating gun of this type is known generally from the prior art.

Spray coating guns may be manual spray guns, which are manually held, or automatic spray guns, which may be held by a carrier and arranged movably in relation to an object or fixed in place. The carrier may be a lifting stand or a robot.

Furthermore, it is known from the prior art to provide spray guns of this type with at least one electrode, which can be connected to a high DC voltage for the electrostatic charging of the coating liquid.

It is also already known to feed to the spray gun a compressed air as atomizing air, which positively influences the atomization of the coating liquid. As an alternative or in addition to this, it is also possible to feed to the spray gun a forming air, which is directed at the liquid sprayed from a spray nozzle in order to form the spray jet, for example in order to form a flat spray jet from a cross-sectionally round spray jet and/or in order to prevent liquid particles from escaping from the atomized spray jet.

The spray coating apparatuses known from the prior art usually comprise a spray coating gun which includes a liquid discharge valve, which has a liquid valve seat and a liquid valve body in the form of a valve needle with a conical needle tip. The liquid valve body is linearly movable in relation to the liquid valve seat between a completely closed liquid valve position and a completely open liquid valve position. In this respect, the actuation of the liquid valve body takes place in the direction of flow by a compression spring and in the opening direction counter to the force of the compression spring by compressed control air in a compressed-control-air chamber on a control piston, which is connected to the liquid valve body for the joint linear movement.

In the case of conventional spray coating guns, the liquid valve seat is usually formed on the rear side of a nozzle channel of an atomizer nozzle, which on its rear side atomizes coating liquid that is fed through a liquid channel and is on the front side of the atomizer nozzle, when the liquid discharge valve is open.

In the case of the conventional spray coating guns described above, it has been found in practice to be disadvantageous that the liquid valve integrated in the gun body, comprising the valve body and the valve needle that is movable in relation to the valve body, is susceptible to faults, particularly in the case of quick-drying coating liquids, since the coating liquid can sediment on the movable components of the liquid valve, as a result of which predictable metering of the coating liquid is no longer possible.

On the basis of this problem, it is an object of the invention to develop a spray coating apparatus of the type mentioned at the beginning to the extent that it operates reliably even when spraying quick-drying coating liquids.

This object is achieved according to the invention with a spray coating apparatus of the type mentioned at the beginning by the coating material tube extending from the nozzle at the front end of the coating material tube to a connection piece at the rear end of the coating material tube, and by a metering system which can be connected to the rear end of the coating material tube by means of the connection piece being provided for setting the amount of coating material that is fed to the nozzle per unit of time.

The advantages that can be achieved with the invention are obvious. The fact that, in the case of the solution according to the invention, the amount of coating material that is fed to the nozzle per unit of time is no longer provided with the aid of a liquid discharge valve, comprising a liquid valve seat and a valve needle that is movable in relation thereto, but with the aid of a metering system provided outside the gun body makes it possible in a way that is particularly easy to realize, but nevertheless effective, to prevent movable components within the spray coating gun from being inoperative, or only operative to a limited extent, as a result of sedimented coating liquid. Dispensing with a conventional liquid discharge valve within the spray coating gun also means that the control air for opening the liquid discharge valve is no longer needed, which leads to further simplification of the spray coating gun.

Advantageous developments are specified in the subclaims.

In a particularly preferred realization of the spray coating apparatus according to the invention, the metering system for setting the amount of coating material that is fed to the nozzle per unit of time is configured as a metering pump, the pump outlet of the metering pump being connected, or able to be connected, to the coating material tube by means of the connection piece. In this respect, it is preferably provided that the delivery rate of the metering pump can be set, in order in this way to regulate the amount of coating material that is fed to the nozzle per unit of time. Reciprocating piston pumps, hose pumps, diaphragm pumps or gear pumps come into consideration, for example, as metering pumps. It goes without saying, however, that other embodiments of suitable metering pumps are also conceivable.

In a preferred development of the spray coating apparatus according to the invention, it is provided that the coating material tube extending from the nozzle to the connection piece is formed in one piece. This makes a quick exchange of the coating material tube possible, for example for the purpose of cleaning or when there is a change of coating material. In this respect, the coating material tube is preferably exchangeably held in the gun body.

In order furthermore to prevent the coating liquid from sedimenting on the components of the nozzle assembly, it is provided in a preferred development of the spray coating apparatus according to the invention that the compressed atomizer air that is to be fed to the spray coating gun is discharged before being fed to the spray coating gun, so that, after feeding the compressed atomizer air, the gun body is likewise cooled down. This causes condensation of the ambient moisture, which in turn prevents attachment of the coating material on the individual components of the spray coating gun and, in particular, on the components of the nozzle assembly, such as for instance on the air flap. In a preferred realization of the last-mentioned embodiment, a vortex tube cooler may be used for cooling down the compressed atomizer air. In this way, the compressed atomizer air can be cooled to approximately −20° C. (measured directly at the cooler output), as a result of which cooling of the gun body to about 0° C. to 5° C. is possible. The cooling power of the vortex tube cooler is adjustable by means of a setting screw and the input air pressure.

The invention is described below with reference to the drawings, on the basis of an embodiment given as an example. In the drawings.

Figure 1:
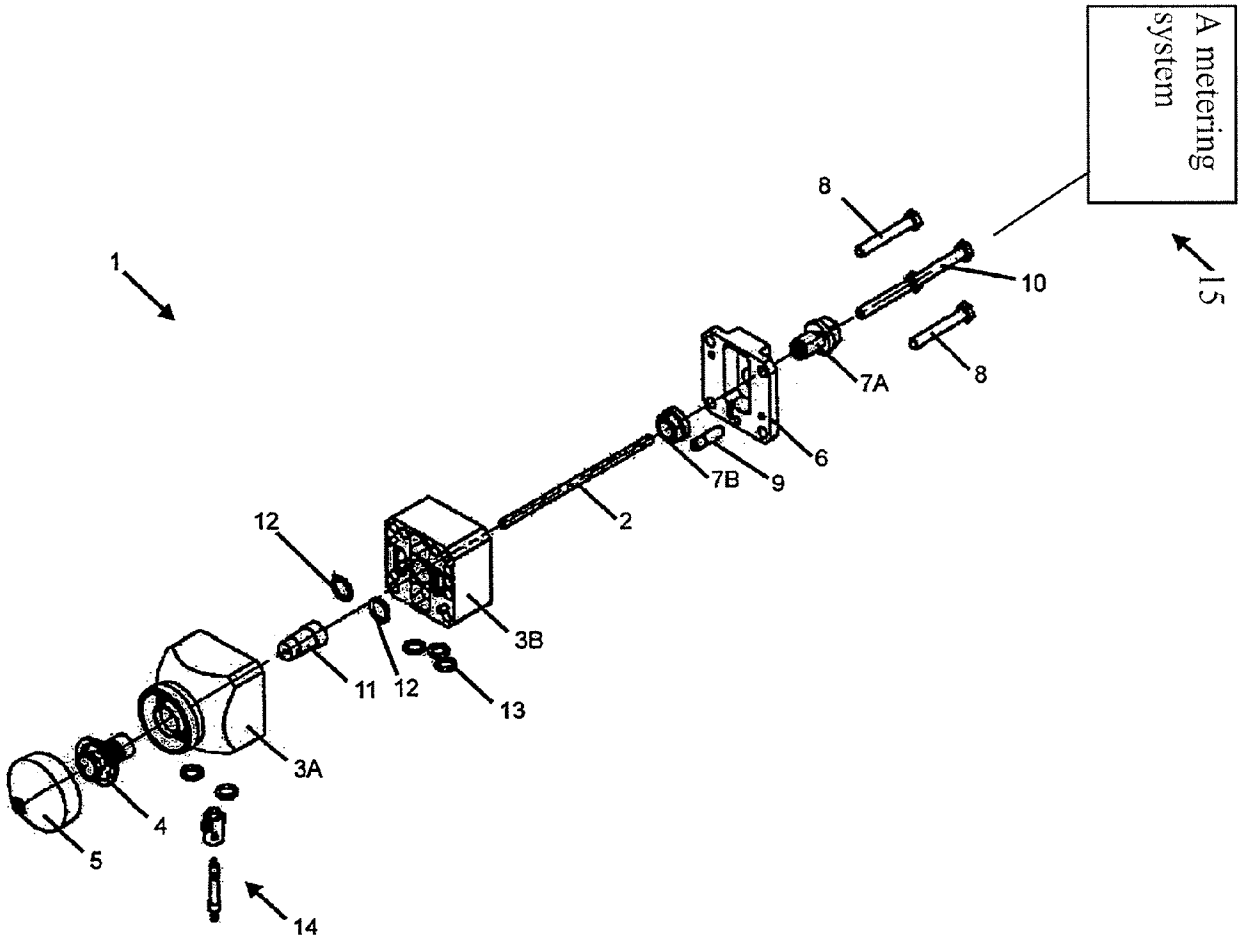
FIG. 1 shows a perspective view in an exploded representation of a spray coating gun that is used in the case of a spray coating apparatus according to the present invention.
Figure 2:
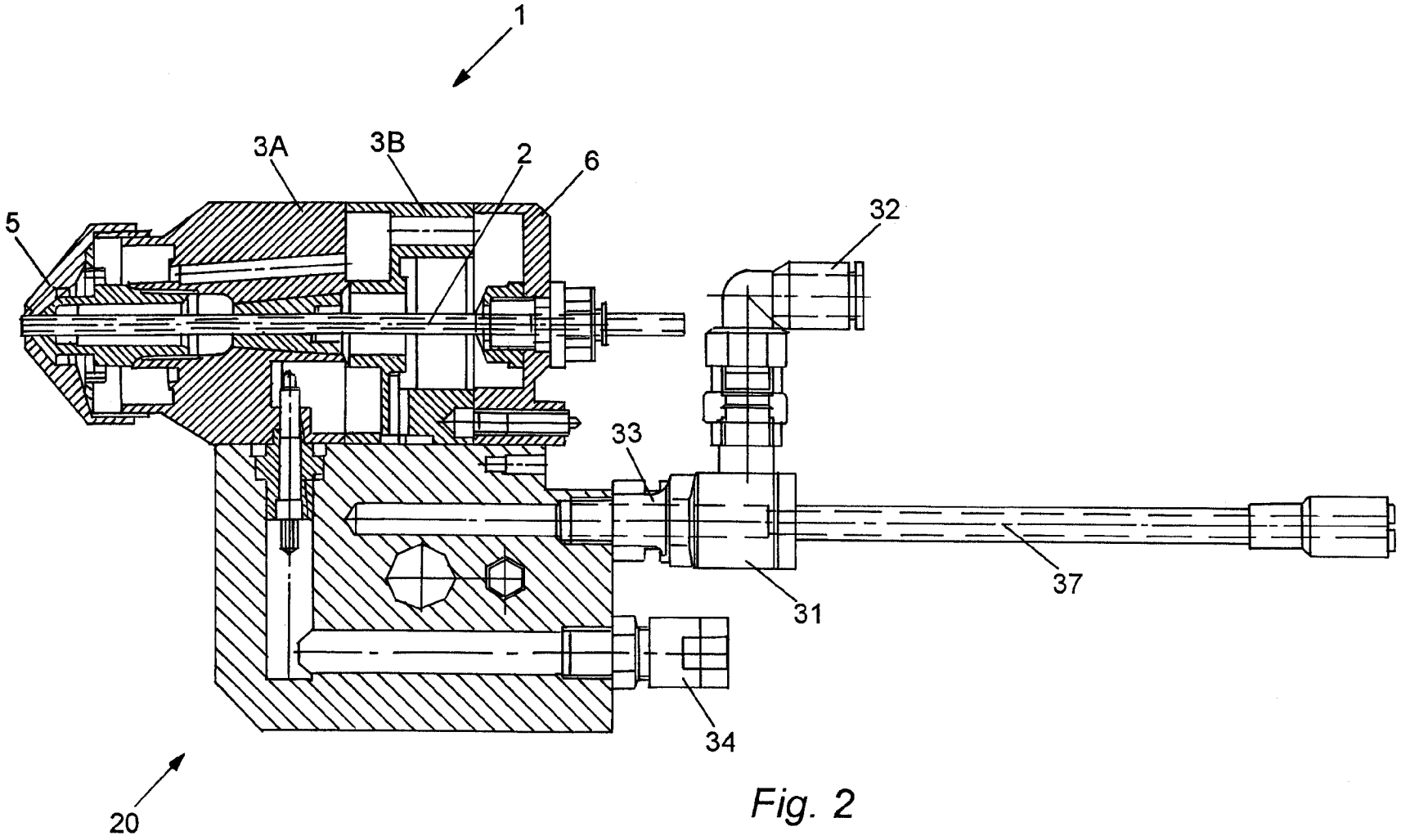
FIG. 2 shows a sectional view of the spray coating gun represented in FIG. 1 that is fitted on a machine adapter.

In FIGS. 1 and 2, a spray coating gun 1 for coating material, in particular coating liquid, is represented, this spray coating gun 1 being able to be used in a spray coating apparatus according to the invention.

The spray coating gun 1 comprises a gun body 3, which includes a gun head 3A and a head holder 3B, and a coating material tube 2, which extends through the gun body 3 and is connected at the front end to a nozzle assembly and at the rear end to a connection piece 7. The connection piece 7 may be an adapter which is connected by means of a system of lines to a metering system 15. As already stated generally, a metering pump is appropriate for the metering system, the pump output of the metering pump being connected, or able to be connected, to the rear end of the coating material tube 2 by means of the connection piece 7. The amount of coating material that is fed to the nozzle assembly per unit of time by means of the coating material tube 2 is in this case set by means of the metering system. For this purpose, it is appropriate, for example, to regulate correspondingly the delivery rate of a metering pump that is used as the metering system.

The nozzle assembly at the front end of the gun body 3 includes a gun head 3A, a nozzle 4 and an air cap 5, and it may use an atomizing and pattern-forming air stream in order to atomize the coating material to be sprayed, and in order to achieve pattern forming. The nozzle assembly is known in principle from the prior art and is not described in any more detail here.

As indicated in FIG. 1, the gun head 3A may be connected to a machine adapter that is not indicated in the figure by means of a locking device 14, optionally with an intermediate plate between the gun head 3A and the machine adapter. The locking device 14 may be formed here as a patented locking device with the machine adapter 20 or the intermediate plate. The patented locking device may, for example, be in the form of a quick-acting arresting mechanism. This allows the spray coating gun 1 as a whole to be quickly separated from the machine adapter or from the intermediate plate for servicing or cleaning merely by turning through a predetermined angle in a certain direction. Accommodated in the gun head 3A is a nozzle 4, which sprays the coating material specifically for application onto a surface. The nozzle assembly may include a fluid valve for controlling a stream of fluid to the nozzle assembly. An air cap 5 is arranged downstream.

The spray coating gun 1 may be formed here in such a way that it makes compressed-air atomization possible. Although not indicated in the figure, high-voltage electrodes which electrostatically charge the coating material may be arranged, whereby said material is applied accurately and with virtually no loss onto a grounded processing surface. When the spray coating gun is realized as an electrostatic gun, shock protection for protection from high voltage and a high-voltage generator should be provided.

Adjoining the gun head 3A upstream is the head holder 3B, the outer dimension of which corresponds to the outer dimension of the gun head 3A. For the transfer of the compressed air, O-rings 12 are arranged between the gun head 3A and the head holder 3B. The head holder 3B may be connected to the gun head 3A by means of mechanical fastening devices, for example plug-in connections or bolts 8. Arranged in the head holder 3B is a seat 11 for the coating material tube 2. For the transfer of the compressed air, O-rings 13 are arranged between the head holder 3B and the machine adapter 20. In the case of conventional spray coating apparatuses from the prior art, a needle assembly or a liquid valve seat was mounted in the head holder. For reasons of cost-effectiveness, this conventional head holder can continue to be used here, the needle assembly or the liquid valve seat then being replaced by the seat 11 for the coating material tube 2. The coating material tube 2 extends through the entire spray coating gun 1 and is supplied with coating material by the metering system, the amount of this material being set by the metering system. As a result, there is no need to provide a conventional liquid discharge valve within the spray coating gun and, furthermore, there is no need to provide the control air for opening the liquid discharge valve, which leads to a simplification and cost reduction of the spray coating gun.

Arranged following the head holder 3B upstream is an end plate 6, the outer dimension of which corresponds to the outer dimension of the head holder 3B. The end plate 6 may be fastened to the head holder 3B and the gun head 3A by means of long bolts or hexagon bolts 8, which extend through the end plate 6 and the head holder 3B and are in engagement with a corresponding thread in the gun head 3A. The coating material tube 2 is held on the end plate 6 and closed off by means of a connection piece 7. The connection piece 7 comprises a shot connection 7A, which may include a thread. This shot connection 7A is inserted from outside through a passage through the end plate 6, until an end face with a diameter that is greater than the diameter of the passage through the end plate 6 comes up against the outer side of the end plate 6. The threaded portion of the shot connection 7A is engaged from the opposite side by a threaded nut 7B. In this embodiment, the coating material tube 2 ends at the connection piece 7 and adjoins a further connecting line (not shown), which is connected to the metering system. The coating material tube 2 may be connected to a threaded pin 10 with a through-channel or slot and optionally be held in this way.

FIG. 2 shows the spray coating gun 1 that is fitted on the machine adapter 20. Optionally, an intermediate plate may be arranged between the spray coating gun 1 and the machine adapter 20. As already explained above, the connection is performed by means of a locking device 14, which in this embodiment is a quick-acting closure. Fastened to the machine adapter 20 is a strain relief 34, which secures a high-voltage cable (not indicated) and prevents it from being detached. The high-voltage cable may run through a channel in the machine adapter 20, through an opening, to a corona discharge device in the spray coating gun 1 that is not indicated in this embodiment. The corona discharge device includes one or more high-voltage electrodes for the electrostatic charging of the coating material. The machine adapter 20 also includes a compressed-air feed line 37 for supplying compressed atomizer air.

As a difference from the previously known, conventional spray coating guns, in the case of the spray coating gun 1 represented in FIG. 2 a compressed-air cooler is also provided in the compressed-air feed line 37 of the spray coating gun 1. With this compressed-air cooler, which may for example be configured in the form of a vortex tube cooler 31, the compressed atomizer air is cooled, so that the gun body 3 of the spray coating gun 1 is also correspondingly cooled down. In this way, condensation of the ambient moisture occurs, which in turn prevents attachment of the coating material on the air cap 5. Attached to the vortex tube cooler 31 is a screw-on connection 32 for the supply of a cooling fluid.

Although not explicitly represented, horns with forming gas outlets for compressed forming gas may be provided, protruding forward beyond the atomizer nozzle, forming the atomized coating liquid jet of the nozzle channel and being fed, for example, by means of a compressed gas channel. In addition to the forming gas outlets or instead of them, one or more atomizer gas outlets may be provided at the front end of the spray coating gun 1, for example in the atomizer nozzle and/or in the horns, by means of which outlets compressed atomizer gas can flow out and assist the atomization of the coating liquid. The compressed atomizer gas may be supplied by means of the same compressed gas channel as the compressed forming gas or through a compressed gas channel that is separate from it.

In or next to the flow path of the coating liquid, preferably downstream from the nozzle channel, the one or more high-voltage electrodes for the electrical charging of the coating liquid may be arranged.

Figure 3:
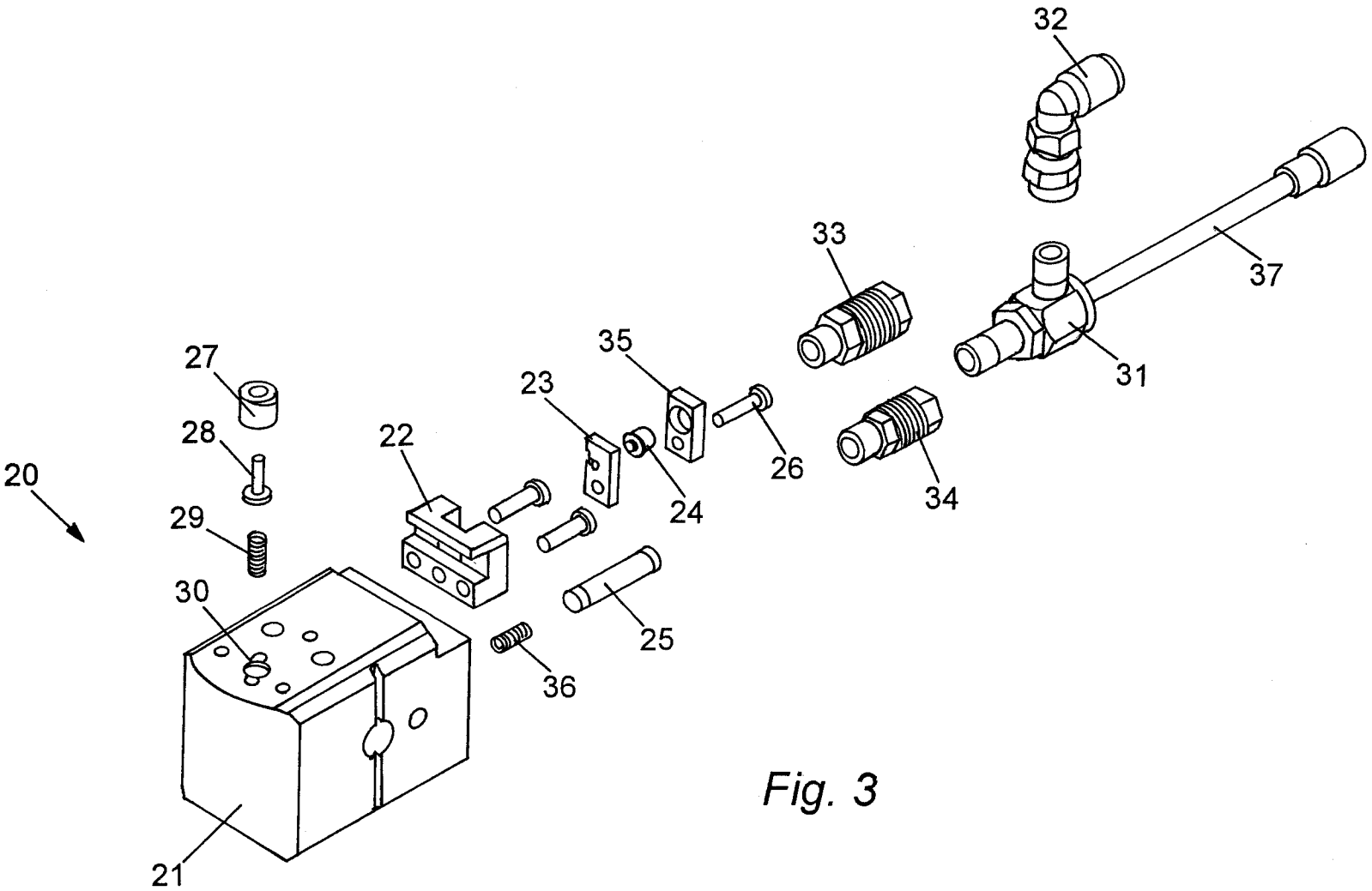
FIG. 3 shows a perspective view in an exploded representation of the machine adapter for receiving the spray coating gun shown in FIGS. 1 and 2.

FIG. 3 shows a perspective view of the machine adapter 20. The machine adapter 20 includes a main body 21, to which an optional stop plate 22 can be fastened. In this embodiment, the stop plate 22 is fastened to the main body 21 by means of bolt 26. Attached to the stop plate 22 is a pressure plate 23, in which a pressure piece 24 is incorporated. This unit is fixed to the main body 21 by means of a holding plate 25, which is fastened to the stop plate 22 or to the main body 21 by means of a further bolt 26. Recessed in the main body 21 is a compression spring 36, which presses against a resistance element 35. Furthermore, the connection 33 for the vortex tube cooler and the strain relief 34 for the high-voltage cable are fastened to the machine adapter 20. The fastening may take place by means of pressing in or a threaded connection. The connection 33 for the vortex tube cooler is adjoined by the vortex tube cooler 31, to which furthermore the screw-on connection 32 is fastened. The vortex tube cooler 31 is supplied with a cooling fluid by means of the screw-on connection 32 and is supplied with compressed atomizer air by means of the compressed-air feed line 37. To connect the spray coating gun 1 to the machine adapter 20, recessed within the main body 21 on the upper side thereof are a guiding piece 27, a contact piston 28 and a compression spring 29. The compression spring 29 exerts pressure on the contact piston 28, so that a piston of the contact piston 28 is pressed upward into the guiding piece 27, whereby a connection with the locking device 14 (see FIG. 1) is achieved.

Figure 4:
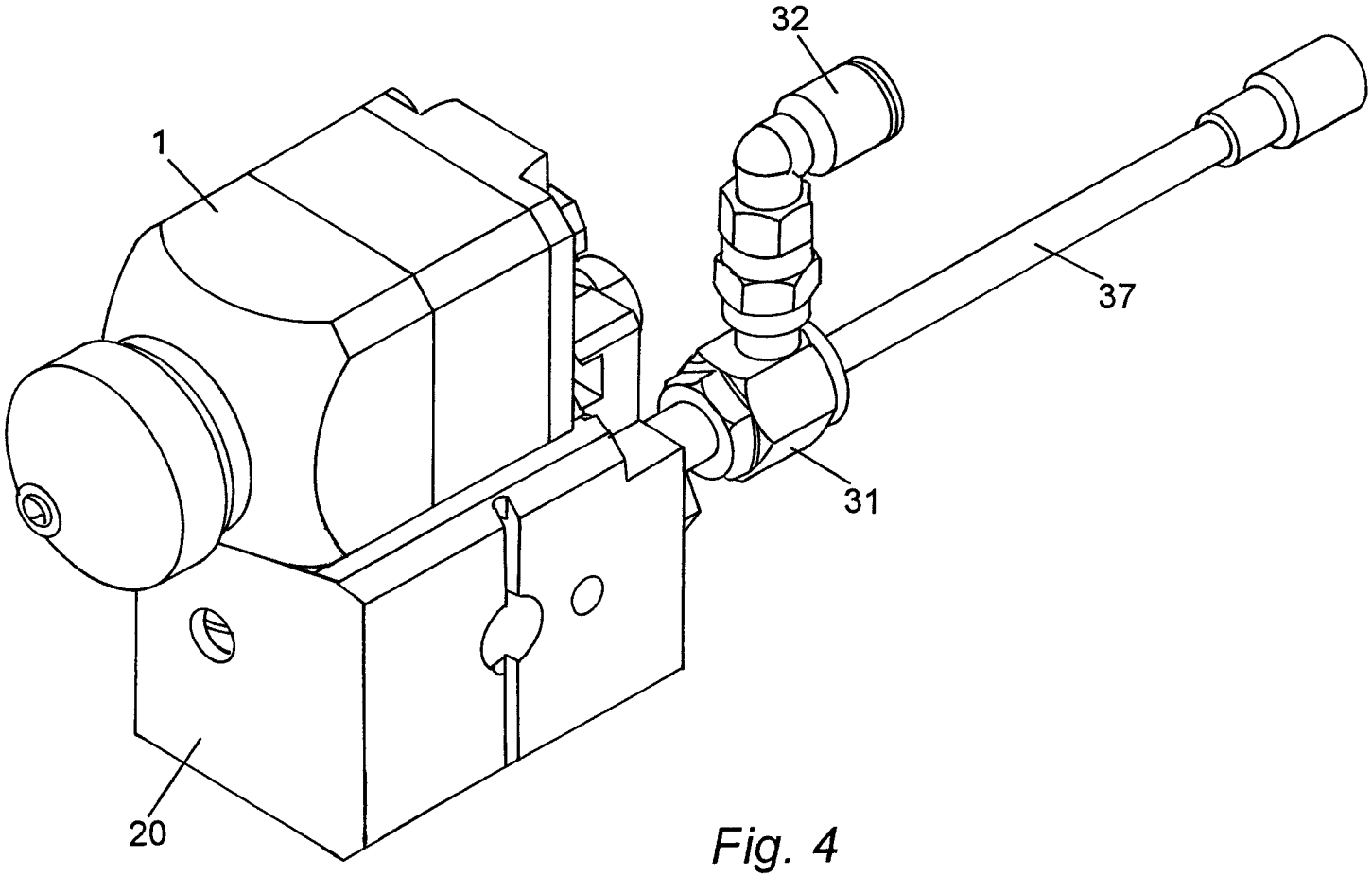
FIG. 4 shows a perspective view of a spray coating apparatus in the assembled state.

FIG. 4 shows the spray coating apparatus in which the spray coating gun 1 is fitted on the machine adapter 20. In this embodiment, the spray coating apparatus is fed a compressed atomizer air by means of a compressed-air feed line 37 and said air is cooled down in the vortex tube cooler 31 by a cooling fluid which is fed to the vortex tube cooler 31 by means of the screw-on connection 32. Although not indicated in the figure, the spray coating gun 1 is fed the coating material by way of a metering system, the amount and metering of the coating material being set by means of the metering system.

Consequently, the spray coating gun 1 does not contain any mechanically actuated components to which quick-drying coating materials in particular can become attached and clog them. A further advantage is that the number of components within the spray coating gun 1 is reduced, and in particular a reduced number of spare parts is necessary, with the overall effect of lowering the operating costs. The spray coating gun 1 is suitable in particular for processing solvent-or water-based coating materials. The spray coating gun 1 is likewise suitable for being used for materials that are highly corrosive or very abrasive.

In this embodiment, the spray coating gun 1 is connected directly to the machine adapter 20. The fastening of the spray coating gun 1 may, however, also take place by means of an intermediate plate on the machine adapter 20. By virtue of a patented locking device on the intermediate plate, a troublefree, quick change is possible without a tool, for example for performing maintenance or servicing work. The fastening with the quick-acting arresting mechanism is positionally very accurate here. For fastening to the machine adapter 20, the spray coating gun 1 can be positioned at an angle of about 45° to the machine adapter 20. A locking device is thereby introduced into a corresponding seat, after which the spray coating gun 1 is turned clockwise, for example likewise by 45°, until it engages in the locking device.

The spray coating apparatus may be used in a fixed spraying installation. Alternatively, the spray coating apparatus may be fastened to an end boom of movable lifting equipment. Appropriate for this are robots with hollow-wrist technology (hollow-wrist robots). The advantage is that all the flexible supply tubes are integrated in the arm and hand joints of the robot. This prevents damage to these flexible supply tubes and reduces effects of wear. The high precision of the hollow-wrist technology makes precise positioning of the spray coating apparatus possible. The available operating range is above-average, since the main part can rotate by a very great pivoting range in every direction. In this way it is possible to spray even workpieces of a very complex shape and regions that are difficult to reach, for example on the rear side. Alternatively, it is also possible to use robots with flexible arm technology and stands.

The invention is not restricted to the present embodiments and can be extended to further embodiments.

LIST OF DESIGNATIONS

1 spray coating gun
2 coating material tube
3 gun body
3A gun head
3B head holder
4 nozzle
5 air cap
6 end plate
7 connection piece
7A shot connection
7B threaded nut
8 long bolt
9 resilient pressure piece
10 threaded pin
11 seat for coating material tube
12, 13 O-rings
14 locking device
20 machine adapter
21 main body
22 stop plate
23 pressure plate
24 pressure piece
25 holding plate
26 bolts

27 guiding piece
28 contact piston
29 compression spring
30 receptacle for a locking device
31 vortex tube cooler
32 screw-on connection
33 connection for vortex tube cooler
34 strain relief
35 resistance element
36 compression spring
37 compressed-air feed line

The invention claimed is:

1. A spray coating apparatus for coating material, comprising a gun body, a cylindrical coating material tube, which includes a front end and a rear end and extends through the gun body, a nozzle provided at the front end of the cylindrical coating material tube, and arranged to spray coating material fed to the nozzle by the coating material tube, a connection piece at the rear end of the coating material tube, and a metering system connected to the coating material tube by means of the connection piece for setting an amount of coating material that is fed to the nozzle per unit of time, wherein the diameter of the front end of the cylindrical coating material tube is same as the diameter of the rear end of the cylindrical coating material tube, and wherein the front end of the cylindrical coating material tube defines the part of the coating apparatus from which the coating material enters the nozzle.

2. The spray coating apparatus according to claim 1, wherein the metering system is arranged outside the gun body.

3. The spray coating apparatus according to claim 1, wherein the coating material tube, which extends between the nozzle at the front end and the connection piece at the rear end of the coating material tube, is formed in one piece.

4. The spray coating apparatus according to claim 1, wherein the gun body includes a gun head at a front end of the gun body and a head holder at a rear end of the gun body, and the gun head and the nozzle together define a nozzle assembly.

5. The spray coating apparatus according to claim 4, further comprising a compressed air cooler for cooling pattern-forming and atomizing air fed to the nozzle assembly, wherein the nozzle assembly further comprises an air cap being arranged at the front end of the gun body.

6. The spray coating apparatus according to claim 4, wherein the nozzle assembly is configured for electrostatic application of the coating material.

7. A spray coating apparatus for coating material, comprising a spray coating gun, including a gun body, a cylindrical coating material tube, which includes a front end and a rear end and extends through the gun body, and a nozzle provided at the front end of the cylindrical coating material tube, and arranged to spray coating material fed to the nozzle by the cylindrical coating material tube, a machine adapter connected to the spray coating gun, and including a compressed air cooler for cooling pattern-forming and atomizing air fed to the nozzle, and a connection piece at the rear end of the cylindrical coating material tube, wherein the diameter of the front end of the cylindrical coating material tube is same as the diameter of the rear end of the cylindrical coating material tube, and wherein the front end of the cylindrical coating material tube defines the part of the coating apparatus from which the coating material enters the nozzle.

8. A spray coating apparatus for coating material, comprising, a spray coating gun, including a gun body having a gun head at a front end of the gun body and a head holder at a rear end of the gun body, a cylindrical coating material tube, which includes a front end and a rear end and extends through the gun body, and a nozzle provided at the front end of the cylindrical coating material tube, and arranged to spray coating material fed to the nozzle by the cylindrical coating material tube, the gun head and the nozzle together define a nozzle assembly.

a machine adapter connected to the spray coating gun, and including a compressed air cooler for cooling pattern-forming and atomizing air fed to the nozzle, and a connection piece at the rear end of the cylindrical coating material tube, wherein the nozzle assembly is configured for electrostatic application of the coating material, wherein the diameter of the front end of the cylindrical coating material tube is same as the diameter of the rear end of the cylindrical coating material tube, and wherein the front end of the cylindrical coating material tube defines the part of the coating apparatus from which the coating material enters the nozzle.

9. The spray coating apparatus for coating material of claim 8, wherein the compressed air cooler is a vortex cooler tube.

* * * * *